United States Patent [19]

Blaese

[11] Patent Number: 4,875,051

[45] Date of Patent: Oct. 17, 1989

[54] ANTENNA WITH IMPEDANCE MATCHING MEMBER

[76] Inventor: Herbert R. Blaese, 3314 Olcott Ave., Chicago, Ill. 60634

[21] Appl. No.: 190,001

[22] Filed: May 4, 1988

[51] Int. Cl.[4] ..... H01Q 1/32

[52] U.S. Cl. ..... 343/715; 343/864

[58] Field of Search ..... 343/713, 715, 745, 860, 343/862, 864, 749, 750

[56] References Cited

U.S. PATENT DOCUMENTS

| | | | |
|---|---|---|---|
| 3,474,453 | 10/1969 | Ireland | 343/750 |
| 3,513,472 | 5/1970 | Altmayer | 343/861 |
| 4,152,704 | 5/1979 | Burg | 343/745 |
| 4,238,799 | 12/1980 | Parfitt | 343/715 |
| 4,521,784 | 6/1985 | Nemet | 343/862 |
| 4,644,364 | 2/1987 | Parks | 343/864 |
| 4,658,259 | 4/1987 | Blaese | 343/715 |
| 4,764,773 | 8/1988 | Larsen et al. | 343/715 |

OTHER PUBLICATIONS

Antenna Engineering Handbook 2nd Ed., Jaskik ed. 1984, 43-12.

*Primary Examiner*—Rolf Hille
*Assistant Examiner*—Doris J. Johnson
*Attorney, Agent, or Firm*—Gerstman & Ellis, Ltd.

[57] ABSTRACT

An on-glass antenna for a vehicle is provided having a radiator for location on the outside of the vehicle window and a cable for location on the inside of the vehicle window for coupling the radiator to a transmitter/-receiver. The cable comprises a first cable portion, a second cable portion, and an impedance matching member at the intersection of the first and second cable portions. The first cable portion and the impedance matching member together have a combined electrical length of about ¼ wavelength.

15 Claims, 1 Drawing Sheet

FIG. 1
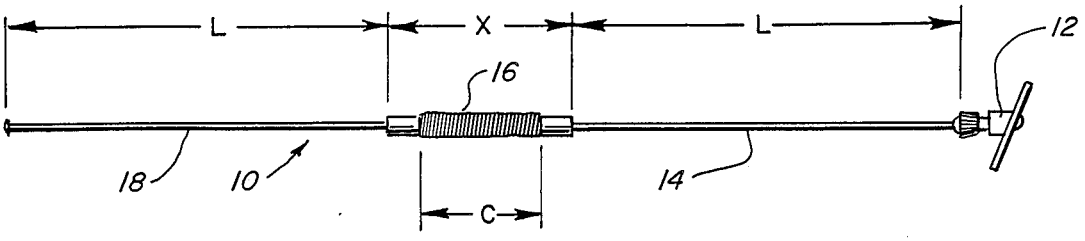
FIG. 2
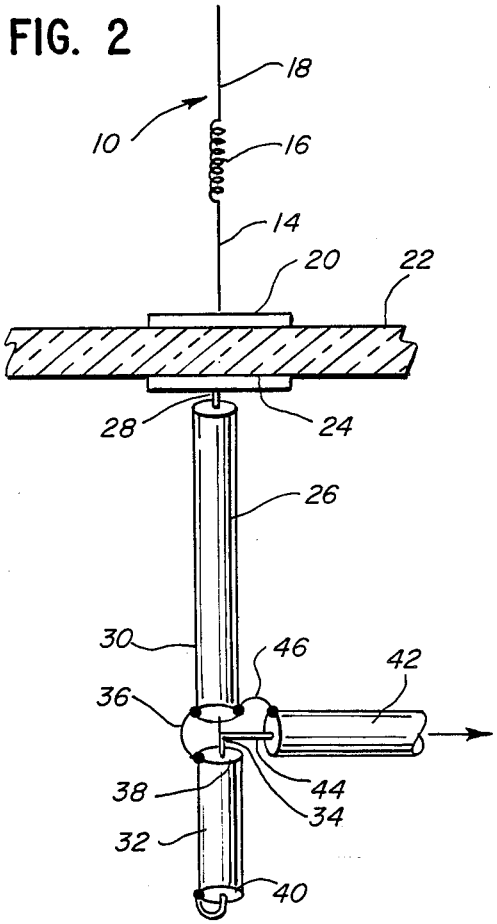
FIG. 4
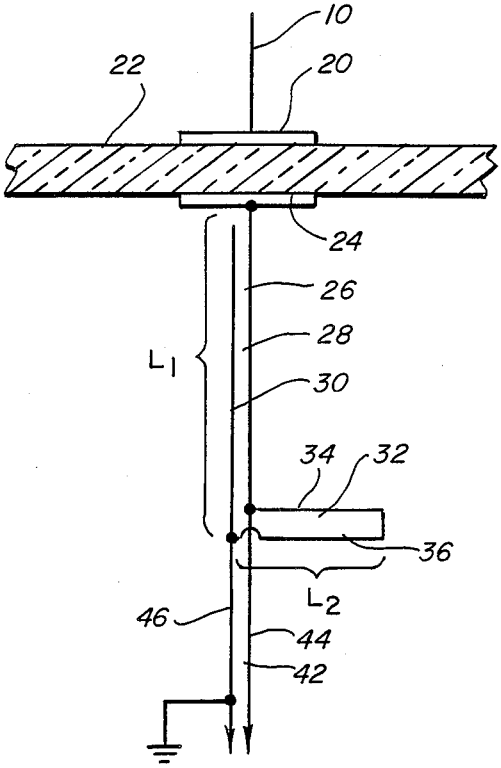
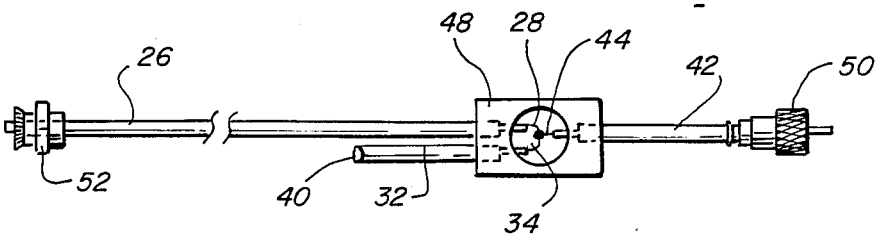
FIG. 3

ANTENNA WITH IMPEDANCE MATCHING MEMBER

FIELD OF THE INVENTION

The present invention concerns a novel on-glass antenna for a motor vehicle.

BACKGROUND OF THE INVENTION

In conventional on-glass voltage fed vehicle antennas such as disclosed in Parfitt U.S. Pat. No. 4,238,799, an adjustable LC network is required at the vehicle window. Adjustability of the components is necessary because of the tolerances with respect to the inductor and capacitor of the network. Typically, variable capacitors are used so that the network can be adjusted for resonance. It is necessary that both the network and the antenna be in tune. However, when the network is adjusted, the length of the antenna may also have to be adjusted. Often the antenna will be adjusted to an erroneous length which will require compensation of the LC network to bring the assembly to resonance, indicating to the operator that the tuning is proper, but there is a loss of gain resulting from the compensating action. In other words, because of the two variables, compensation of one of the variables may result in less gain than optimum although to the operator there may appear to be a proper match.

In Blaese U.S. Pat. No. 4,658,259, a current fed antenna is disclosed which obviates the requirement for the LC network at the window. This current fed antenna is very well suited for use with relatively high frequencies, such as used with cellular telephones. However, with lower frequency antennas such as in the citizens band (27 megahertz) the current fed antenna disclosed in Blaese U.S. Pat. No. 4,658,259 is impractical. This is because the lower frequency antenna requires an extremely large ground plane, of a magnitude that may be so large as to cover the entire back window of the vehicle.

It is an object of the present invention to provide an on-glass antenna which is useful with lower frequencies as well as higher frequencies and which does not require a matching LC network at a coupling box that connects the antenna to the window.

Another object of the invention is to provide an on-glass antenna for a vehicle which does not require adjustment of any LC network, thereby providing only a single variable for adjustment, i.e., the length of the antenna.

A further object of the present invention is to provide an on-glass antenna for a vehicle that is simple in construction and easy to manufacture.

Other objects and advantages of the present invention will become apparent as the description proceeds.

SUMMARY OF THE INVENTION

In accordance with the present invention, an on-glass antenna is provided for use with a desired frequency, for connection to the window of a vehicle. The antenna comprises a radiator for location on the outside of the vehicle window and connected to a first transfer member fastened to the outside of the vehicle window. A second transfer member is fastened to the inside of the vehicle window in substantial alignment with the first transfer member.

A cable is provided for coupling the radiator to a transmitter/receiver. The cable comprises a first cable portion having a first end and a second end and an impedance matching member. The first cable portion includes a first conductor and a spaced second conductor. The first and second conductors extend substantially from the first end of the first cable portion to the second end thereof. The first conductor at the first end of the first cable portion is connected to the second transfer member.

The impedance matching member comprises an electrical conductor bridging the first conductor to the second conductor of the first cable portion at the second end of the first cable portion. The impedance matching member and the first cable portion together have an electrical length of about $\frac{1}{4}$ wavelength with respect to the desired frequency.

In the illustrative embodiment, the first cable portion is coaxial cable, with the first conductor comprising the central conductor of the coaxial cable and the second conductor comprising the outer conductor of the coaxial cable.

In the illustrative embodiment, the first cable portion and the impedance matching member have a combined electrical length of about $\frac{1}{4}$ wavelength added to zero or added to any multiple of $\frac{1}{2}$ electrical wavelengths. The impedance matching member has a length that is a small fraction of the length of the first cable portion.

In the illustrative embodiment, the impedance matching member comprises a cable portion including a first conductor and a spaced second conductor with the first and second conductors being shorted at one end of the cable portion and with the first conductor at the other end of the cable portion being connected to the first conductor at the second end of the first cable portion.

A more detailed explanation of the invention is provided in the following description and claims, and is illustrated in the accompanying drawings.

BRIEF DESCRIPTION OF THE DRAWINGS

FIG. 1 is a view of a radiator constructed in accordance with the principles of the present invention;

FIG. 2 is a diagrammatic view of an on-glass antenna constructed in accordance with the principles of the present invention;

FIG. 3 is an elevational view of a portion of an antenna constructed in accordance with the principles of the present invention, with portions shown in diagrammatic form for clarity; and FIG. 4 is a diagrammatic view of an on-glass antenna in accordance with the principles of the present invention.

DETAILED DESCRIPTION OF THE ILLUSTRATIVE EMBODIMENT

The on-glass antenna of the present invention comprises an end fed antenna preferably utilizing a $\frac{1}{2}$ wavelength radiator as illustrated in FIG. 1. Although the illustrative embodiment will be described with respect to the citizens band (27 megahertz), it is understood that no limitation with respect to the desired frequency is intended.

In the illustrative embodiment, the radiator 10 for citizens band includes a slant swivel base 12 with a spring contactor. Radiator 10 comprises a conductive rod including a proximal portion 14 having a length L equal to 20.25 inches, a loading coil 16 having an overall length X of 10 inches with a load coil 7.5 inches in length of closely wound wire, and a distal portion 18 having a length L' of 20.25 inches. Proximal portion 14 has a $\frac{1}{8}$ inch diameter and distal portion 18 has a 1/16 inch diameter.

Radiator 10 is connected to an electrically conductive transfer plate 20 fastened to a window 22 of a vehicle. A second electrically conductive transfer plate 24 is fastened to the inside of window 22 in alignment with first transfer plate 20.

The antenna includes a first cable portion 26 which is preferably a 50 ohm coaxial cable having a central conductor 28 and an outer coaxial conductor 30, covered with insulation as conventional. Conductors 28 and 30 extend substantially the length of the first coaxial cable portion 26.

Central conductor 28 is fastened by suitable means to second transfer plate 24, and an impedance matching member 32 is provided which bridges conductors 28 and 30 of first cable portion 26. In FIG. 2, impedance matching member 32 comprises a coaxial cable portion having a central conductor 34 and an outer coaxial conductor 36. At one end 38 of impedance matching member 32 central conductor 34 is connected to the central conductor 28 of first cable portion 26 and outer conductor 36 is connected to outer conductor 30 of first cable portion 26. At the opposite end 40 of impedance matching member 32, central conductor 34 and outer conductor 36 are shorted. First cable portion 26 and impedance matching member 32 have a combined electrical length of about $\frac{1}{4}$ wavelength at the desired frequency. It is understood, however, that this combined electrical length of about $\frac{1}{4}$ wavelength could be added to any multiple of $\frac{1}{2}$ electrical wavelength to achieve the proper match. For example, the combined electrical length of first cable portion 26 and impedance matching member could be 1-$\frac{1}{4}$ electrical wavelength, or 1-$\frac{3}{4}$ electrical wavelength, or 2-$\frac{1}{4}$ electrical wavelength, or 2-$\frac{3}{4}$ electrical wavelength, etc., it being understood that the additional half wavelength amounts permit the junction of the first cable portion 26 and the impedance matching member 32 to be further from the window.

A second cable portion 42, which extends toward the transmitter/receiver, is connected at the junction of first cable portion 26 and impedance matching member 32. In FIG. 2, second cable portion 42 comprises a coaxial cable having its central conductor 44 connected to central conductor 34 and 28 and having its outer conductor 46 connected to outer conductors 36 and 30. The length of coaxial cable 42 is irrelevant with respect to the required match; it is the combined electrical length of first cable portion 26 and impedance matching member 32 which is significant.

Referring to FIG. 4, which shows the cable portions in diagrammatic form, it is seen that first cable portion 26 has a first conductor 28 connected to second transfer plate 24 and a second conductor 30 is the "ground" lead. Impedance matching member 32 has a first conductor 34 and a second conductor 36 which serve to bridge conductors 28 and 30. The combined electrical length of first cable portion 26 and impedance matching member 32 is about $\frac{1}{4}$ wavelength, preferably from between 0.2 wavelength to 0.3 wavelength. In the FIG. 4 embodiment, a citizen band antenna is shown in which the length $L_1$ of first cable portion 26 is 65-$\frac{1}{8}$ inches and the length $L_2$ of the impedance matching member 32 is 4-$\frac{3}{4}$ inches.

In FIG. 3, the cable portions are illustrated with impedance matching member 32 comprising a coaxial cable having end 40 shorted and the central conductor 34 of the other end fastened at the intersection of the central conductor 28 of first cable portion 26 and the central conductor 44 of second cable portion 42. The connections are made within brass block 48. A suitable connector member 50 is provided at the end of second cable portion 42 for connection to the transmitter/-receiver and a ferrule 52 is connected at the forward end of first cable portion 26 for connection to second transfer plate 24 which is fastened to the inside of the window in alignment with first transfer plate 20.

As stated above, with respect to FIG. 4 $L_1$ plus $L_2$ is equal to $\frac{1}{4}$ electrical wavelength. The length $L_2$ depends on the radiator used.

Although an illustrative embodiment of the invention has been shown and described, it is to be understood that various modifications and substitutions may be made by those skilled in the art without departing from the novel spirit and scope of the present invention.

What is claimed is:

1. An on-glass antenna for use with a desired frequency for connection to the window of a vehicle, which comprises:

a radiator for location on the outside of the vehicle window;

a first transfer member for fastening to the outside of the vehicle window;

means for connecting said radiator to said first transfer member;

a second transfer member for fastening to the inside of the vehicle window in substantial alignment with said first transfer member;

a cable for coupling said radiator to a transmitter/-receiver, said cable comprising a first cable portion having a first end and a second end, and an impedance matching member;

said first cable portion including a first conductor and a spaced second conductor with said first and second conductors extending substantially from said first end of the first cable portion to said second end thereof;

means connecting said first conductor at said first end of said first cable portion to said second transfer member;

said impedance matching member comprising an electrical conductor bridging said first conductor to said second conductor of said first cable portion at said second end of said first cable portion, said impedance matching member and said first cable portion together having an electrical length of about $\frac{1}{4}$ wavelength with respect to said desired frequency.

2. An antenna as defined in claim 1, said first cable portion being coaxial cable, said first conductor comprising the central conductor of said coaxial cable and said second conductor comprising the outer conductor of said coaxial cable.

3. An antenna as defined in claim 1, said first cable portion and said impedance matching member having a combined electrical length of about $\frac{1}{4}$ wavelength added to 0 or added to any multiple of $\frac{1}{2}$ electrical wavelengths.

4. An antenna as defined in claim 3, in which said impedance matching member has a length that is a small fraction of the length of said first cable portion.

5. An antenna as defined in claim 1, in which said impedance matching member comprises a cable portion including a first conductor and a spaced second conductor with said first and second conductors being shorted at one end of said cable portion and with said first conductor at the other end of said cable portion being connected to the first conductor at said second end of said first cable portion.

6. An antenna as defined in claim 1, in which said impedance matching member and said first cable portion together have an electrical length between 0.2 wavelength and 0.3 wavelength.

7. An on-glass antenna for use with a desired frequency for connection to the window of a vehicle, which comprises:

a radiator for location on the outside of the vehicle window;

a first transfer member for fastening to the outside of the vehicle window;

means for connecting said radiator to said first transfer member;

a second transfer member for fastening to the inside of the vehicle window in substantial alignment with said first transfer member;

a cable for coupling said radiator to a transmitter/-receiver, said cable comprising a first coaxial cable portion having a central conductor and an outer conductor and a second coaxial cable portion having a central conductor and an outer conductor;

said central conductor of said second cable portion being connected to said central conductor of said first cable portion;

means connecting said central conductor of said first cable portion to said second transfer member;

an impedance matching member connected at the intersection between said first cable portion and said second cable portion, said impedance matching member comprising an electrical conductor bridging said central conductor and said other conductor, said impedance matching member and said first cable portion together having an electrical length of about $\frac{1}{4}$ wavelength with respect to said desired frequency.

8. An antenna as defined in claim 7, in which said first cable portion and said impedance matching member have a combined electrical length of about $\frac{1}{4}$ wavelength added to 0 or added to any multiple of $\frac{1}{2}$ electrical wavelengths.

9. An antenna as defined in claim 7, in which said impedance matching member and said first cable portion together have an electrical length between 0.2 wavelength and 0.3 wavelength.

10. An antenna for use with a desired frequency for connection to the window of a vehicle, which comprises:

a radiator for location on the outside of the vehicle window;

a first transfer member for fastening to the outside of the vehicle window;

means for connecting said radiator to said first transfer member;

a second transfer member for fastening to the inside of the vehicle window in substantial alignment with said first transfer member;

a cable for coupling said radiator to a transmitter/-receiver, said cable comprising a first cable portion having a first end and a second end, and an impedance matching member;

said first cable portion including a first conductor and a spaced second conductor with said first and second conductors extending substantially from said first end of the first cable portion to said second end thereof;

means connecting said first conductor at said first end of said first cable portion to said second transfer member;

said impedance matching member comprising an electrical conductor bridging said first conductor to said second conductor of said first cable portion at said second end of said first cable portion, said impedance matching member and said first cable portion together having an electrical length of about $\frac{1}{4}$ wavelength with respect to said desired frequency.

11. An antenna as defined in claim 10, said cable being coaxial cable, said first conductor comprising the central conductor of said coaxial cable and said second conductor comprising the outer conductor of said coaxial cable.

12. An antenna as defined in claim 10, said first cable portion and said impedance matching member having a combined electrical length of about $\frac{1}{4}$ wavelength added to 0 or added to any multiple of $\frac{1}{2}$ electrical wavelengths.

13. An antenna as defined by claim 12, in which said impedance matching member has a length that is a small fraction of the length of said first cable portion.

14. An antenna as defined in claim 10, in which said impedance matching member comprises a third cable portion including a first conductor and a spaced second conductor with said first and second conductors being shorted at one end of said third cable portion and with said first conductor at the other end of said third cable portion being connected to the first conductor at said second end of said first cable portion.

15. An antenna as defined in claim 10, in which said first cable portion and said impedance matching member have a combined electrical length between 0.2 wavelength and 0.3 wavelength.

* * * * *